US008316703B2

(12) United States Patent
Sallwasser et al.

(10) Patent No.: US 8,316,703 B2
(45) Date of Patent: Nov. 27, 2012

(54) FLEXIBLE COUPLING FOR WELL LOGGING INSTRUMENTS

(75) Inventors: Alan J Sallwasser, Houston, TX (US); Richard M Wilde, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 950 days.

(21) Appl. No.: 12/109,687

(22) Filed: Apr. 25, 2008

(65) Prior Publication Data

US 2009/0266535 A1 Oct. 29, 2009

(51) Int. Cl.
*E21B 47/12* (2006.01)

(52) U.S. Cl. ..... 73/152.02

(58) Field of Classification Search ..... None
See application file for complete search history.

(56) References Cited

U.S. PATENT DOCUMENTS

| | | | | |
|---|---|---|---|---|
| 3,216,751 | A | 11/1965 | Der Mott | |
| 4,109,717 | A * | 8/1978 | Cooke, Jr. | 166/250.1 |
| 4,614,250 | A | 9/1986 | Panetta et al. | |
| 5,244,050 | A | 9/1993 | Estes | |
| 5,285,008 | A | 2/1994 | Sas-Jaworsky et al. | |
| 5,521,592 | A | 5/1996 | Veneruso | |
| 5,808,191 | A | 9/1998 | Alexy, Jr. et al. | |
| 5,841,734 | A * | 11/1998 | Ritter et al. | 367/35 |
| 5,894,104 | A * | 4/1999 | Hedberg | 174/36 |
| RE36,833 | E * | 8/2000 | Moore et al. | 174/47 |
| 6,269,891 | B1 | 8/2001 | Runia | |
| 6,396,414 | B1 * | 5/2002 | Bickford et al. | 340/855.2 |
| 6,443,247 | B1 | 9/2002 | Wardley | |
| 6,527,513 | B1 | 3/2003 | Van Drentham-Susman et al. | |
| 6,561,278 | B2 | 5/2003 | Restarick et al. | |
| 6,663,453 | B2 | 12/2003 | Quigley et al. | |
| 6,702,041 | B2 | 3/2004 | Runia | |
| 7,134,493 | B2 | 11/2006 | Runia | |
| 7,140,454 | B2 | 11/2006 | Runia | |
| 7,188,672 | B2 | 3/2007 | Berkheimer et al. | |
| 7,281,592 | B2 | 10/2007 | Runia et al. | |
| 7,287,609 | B2 | 10/2007 | Runia et al. | |
| 7,296,639 | B2 | 11/2007 | Millar et al. | |
| 2004/0074639 | A1 | 4/2004 | Runia | |
| 2004/0118611 | A1 | 6/2004 | Runia et al. | |
| 2005/0029017 | A1 | 2/2005 | Berkheimer et al. | |
| 2006/0000619 | A1 | 1/2006 | Borst et al. | |
| 2006/0118298 | A1 | 6/2006 | Millar et al. | |
| 2006/0266512 | A1 | 11/2006 | Lohbeck | |
| 2007/0068677 | A1 | 3/2007 | Angman et al. | |
| 2008/0066905 | A1 | 3/2008 | Aivalis et al. | |
| 2008/0066961 | A1 | 3/2008 | Aivalis et al. | |
| 2008/0156477 | A1 | 7/2008 | Aivalis et al. | |
| 2008/0173481 | A1 | 7/2008 | Menezes et al. | |
| 2009/0038391 | A1 | 2/2009 | Avialis et al. | |

OTHER PUBLICATIONS

Matula, Chuck, "Lower Risk by Logging Through the Bit," Exploration and Production Magazine, Jan. 29, 2009, pp. 1-2. Runia, John, et al., "Through Bit Logging: Applications in Difficult Wells, Offshore North Sea," SPE/IADC Drilling Conference, Feb. 23-25, 2005, pp. 1-8.

Runia, John, et al., "Through Bit Logging: A New Method to Acquire Log Data, and a First Step on the Road to Through Bore Drilling," SPWLA 45th Annual Logging Symposium, Jun. 6-9, 2004, pp. 1-8.

Mahony, James, "Through-Bit Technology May Brighten the Outlook for Tough Logging Conditions," New Technology Magazine, Sep. 2004, pp. 1-3.

* cited by examiner

*Primary Examiner* — Robert R Raevis
(74) *Attorney, Agent, or Firm* — Chamberlain Hrdlicka

(57) ABSTRACT

A flexible coupling for well logging instruments includes a housing coupled at one longitudinal end to one end of a second housing. Each of the housings defines a sealed interior chamber. The housings are coupled to enable angular deflection between respective longitudinal axes thereof. A conduit extends between the housings. The conduit is sealingly engaged to each housing such that longitudinal ends of the conduit are substantially positionally fixed with respect to each housing. The conduit is formed from material and has dimensions selected to withstand at least a same hydrostatic pressure as each of the housings. The conduit includes a bending strain distribution feature configured such that at a maximum angular deflection between housings a bending strain in the conduit is at most equal to an elastic limit of the conduit.

8 Claims, 2 Drawing Sheets

FLEXIBLE COUPLING FOR WELL LOGGING INSTRUMENTS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of well logging instruments. More specifically, the invention relates to flexible couplings used to enable lateral displacement of well logging instrument housings relative to one another.

2. Background Art

Well logging instruments are used to make measurements of physical properties of earth formations from within wellbores drilled through such formations. Some of these instruments, such as neutron porosity measuring devices, make more precise measurements when placed into contact with the wall of the wellbore. Other types of well logging instruments, such as electromagnetic induction resistivity measuring devices, make more precise measurements when radially spaced apart from the wellbore wall by a predetermined distance. Still other types of well logging devices include small sensors which may be placed in contact with the wellbore wall over only a small portion of the circumference of the wellbore wall and over a very short axial length along the wall. These small sensors are generally placed in devices referred to as "pads" or "skids", which selectably extend from the instrument housing to contact the wellbore wall. Common types of pad sensor logging instruments include backscatter-type gamma-gamma density sensors and various forms of very small-scale, or "micro", resistivity devices. As is known in the art, a pad mounted sensor usually includes various linkages for causing the pad to selectably extend from the main housing of the logging instrument which place the pad in firm contact with the wall of the wellbore.

It is generally desirable, for reasons of economy of operation, to assemble as many different types of well logging sensors as is practical together in a single instrument assembly (called a "string") so that many different types of measurements can be made in a single operation of the instrument string in the wellbore. As more logging sensors are assembled in the instrument string, operating the string becomes increasingly difficult, particularly because some of the instruments can be pad-type, others can be intended to be put in contact with the wellbore wall, and still others on the same string need to be separated from the wellbore wall. Conventional logging instruments typically are long enough so that natural flexibility in the instrument housings enables the different types of instruments to be placed in their proper radial positions with respect to the wellbore wall. If conventional logging instruments are used, however, the overall length of the instrument string can become so great as to materially increase the risk of the instrument string becoming stuck in the wellbore, among other hazards.

It is also known in the art to deploy well logging instruments through the interior of a drill string using a particular type of drill bit at the bottom of the drill string that has a selectably releasable closure element. One such system is disclosed in U.S. Pat. No. 6,269,891 issued to Runia.

U.S. Pat. No. 5,808,191 issued to Alexy et al. describes well logging instruments coupled end to end in which a device disposed between the instruments enables lateral displacement of one instrument relative to the other.

A particular design challenge in making and using devices such as those disclosed in the Alexy et al. '191 patent is providing a passage for electrical conductors and related items between the two well logging instruments. As is known in the art, the interior of a typical well logging instrument defines a sealed chamber in which electronic and other components disposed therein are maintained at surface atmospheric pressure. Thus, the device disclosed in the Alexy et al. '191 patent includes an internal passage that is sealed against fluid intrusion from outside the device while enabling relative axial displacement between the two ends of the device. The passage requires a seal mechanism that enables the described relative axial displacement. As will be appreciated by those skilled in the art, seals that enable relative motion between components of an instrument in a wellbore are inherently less reliable than seals that join instruments that are positionally fixed with respect to each other.

It is desirable to have a flexible coupling for well logging instruments that does not require sealing engagement between components able to more relative to one another.

SUMMARY OF THE INVENTION

A flexible coupling for well logging instruments joined end to end according to one aspect of the invention includes a first well logging instrument housing coupled at one longitudinal end to one end of a second well logging instrument housing. Each of the first and second well logging instrument housings defines therein a sealed interior chamber. The first and second instrument housings are coupled so as to enable angular deflection between respective longitudinal axes of the first and second instrument housings. A conduit extending between the first well logging instrument housing and the second well logging instrument housing. The conduit is sealingly engaged to each well logging instrument housing such that longitudinal ends of the conduit are substantially positionally fixed with respect to each well logging instrument housing. The conduit is formed from material and has dimensions selected to withstand at least a same hydrostatic pressure as each of the first and second well logging instrument housings. The conduit includes a bending strain distribution feature configured such that at a maximum angular deflection between the first instrument housing and the second instrument housing a bending strain in the conduit is at most equal to an elastic limit of the conduit.

Other aspects and advantages of the invention will be apparent from the following description and the appended claims.

DETAILED DESCRIPTION

Figure 1:
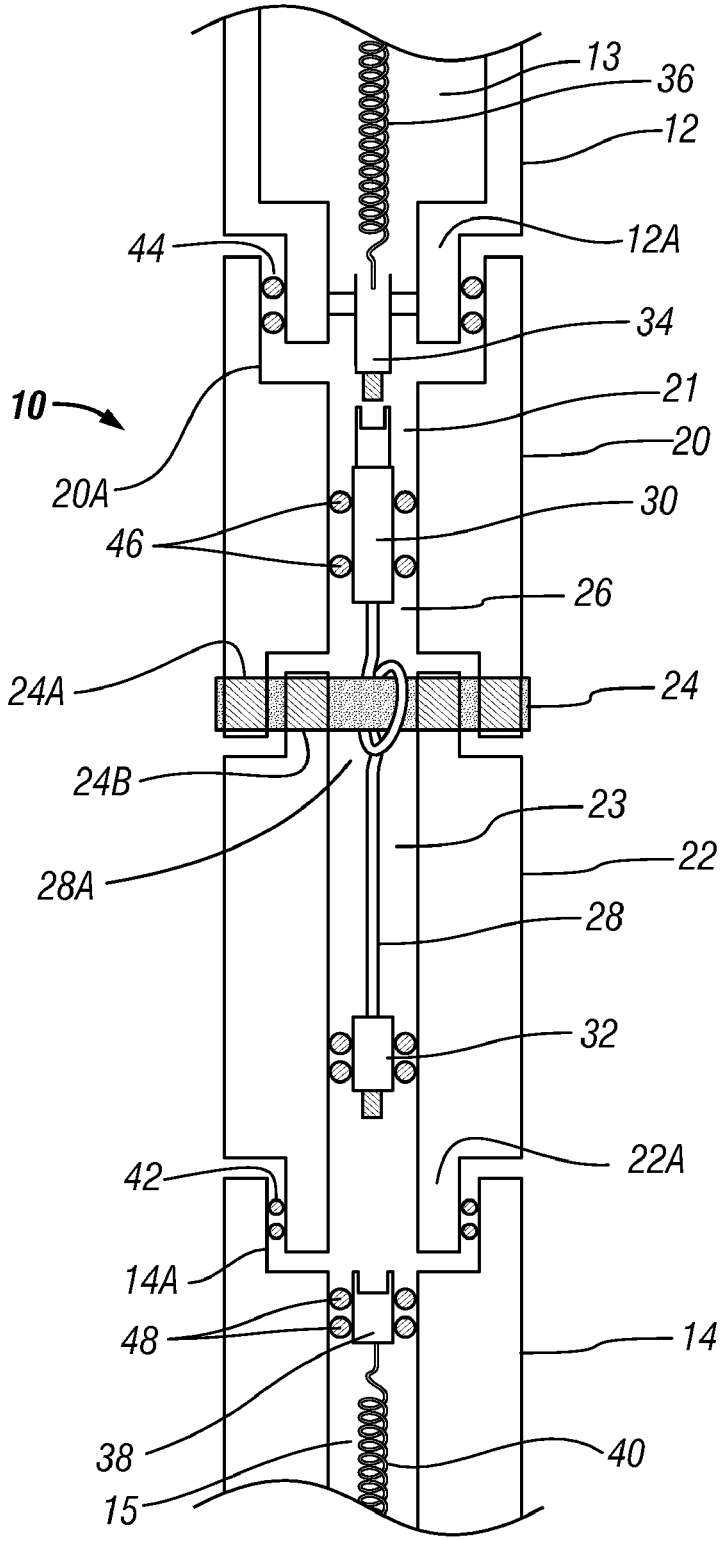
FIG. 1 shows a cross-section of an example flexible coupling joining two well logging instruments end to end.

An example of a flexible coupling for joining two well logging instruments together end to end is shown in cross-section view in FIG. 1. A first well logging instrument housing 12 can be coupled with a mating feature (explained further below) in a first housing segment 20 of a flexible coupling 10. A second well logging instrument housing 14 is coupled in a similar manner into a mating feature (explained below) in a second housing segment 22 of the flexible coupling 10. The first housing segment 20 and the second housing segment 22 of the flexible coupling 10 may be joined together by a pivot, hinge or similar device, shown generally at 24, that enables the longitudinal axis of the first housing segment 20 to be angularly displaced with respect to the longitudinal axis of the second housing segment 22. The pivot 24 in the present example enables angular displacement between the axes of the first 20 and second 22 housing segments, but maintains the housing segments 20, 22 in rotational alignment with each other.

The first well logging instrument housing 12 and the second well logging instrument housing 14 may be made as such instrument housings are known in the art to be made. For example, the housings 12, 14 may be generally cylindrically shaped and made from high strength materials such as stainless steel, titanium or similar metal alloy. The first well logging instrument housing 12 defines a sealed interior chamber 13 which as is known in the art is generally maintained at atmospheric pressure and is configured to exclude fluid from a wellbore from entering the chamber 13 notwithstanding the hydrostatic pressure of such fluid in the wellbore. Thus the first well logging instrument housing 12 may have dimensions selected to resist crushing under the maximum expected hydrostatic pressure in a wellbore. Correspondingly, the second well logging instrument housing 14 defines a similar sealed interior chamber 15 and has similar pressure resistance characteristics. Electronic circuits and other components (not shown) of various types of well logging instruments may be disposed in the respective chambers 13, 15. The type of electronic circuits and other components, as well as the type of sensors disposed in either of the well logging instrument housings 12, 14 are not intended to limit the scope of the present invention.

The first well logging instrument housing 12 may include at its longitudinal end a male extension 12A having diameter selected to fit within a mating feature 20A in the first housing segment 20 of the flexible coupling 10. The male extension 12A may be sealingly engaged to the interior of the first mating feature 20A using o-rings 44 or similar sealing element. When the first well logging instrument housing 12 is coupled to the first housing segment 20, a single exterior diameter may be defined by the joined components. Although not shown in FIG. 1 for clarity of the illustration, the first well logging instrument housing 12 is typically coupled to the first housing segment 20 by a threaded connection, locking ring, collets or similar device that enables transfer of axial loading from the first well logging instrument housing 12 to the first housing segment 20 of the flexible coupling 10. The second well logging instrument housing 14 may define a corresponding feature 14A configured to receive either a male extension 22A of the second housing segment 22 or the male extension 12A of the first well logging instrument housing 12. The arrangement shown in FIG. 1 of the male extension 12A of the first well logging instrument housing 12 and the mating feature 14A of the second well logging instrument housing 14 is conventional, such that the first well logging instrument housing 12 may be coupled directly to the second well logging instrument housing 14, or as shown in FIG. 1, the flexible coupling 10 may form an intervening connection between the two well logging instrument housings.

It should also be understood that for purposes for defining the scope of the present invention, the first well logging instrument housing 12 and the first housing segment may be in the form of a single housing. Additionally, or alternatively, the second well logging instrument housing 14 and the second housing segment 22 may be in the form of a single housing. It is only necessary that the two segments of the flexible coupling be joined pivotally and define internal passages at their longitudinal ends as will be explained below with reference to the first and second housing segments.

The first housing segment 20 may define an interior passage 21 that may include a pressure sealed feed through connector 30 at the end of the interior passage 21 proximate the mating feature 20A. The feed through connector 30 may be sealingly engaged to the interior of the passage 21 by o-rings 46 or similar sealing element(s). An electrical and/or optical connector 34 may be disposed in the male end 12A of the first well logging instrument housing 12 such that when the first well logging instrument housing 12 is engaged to the first housing segment 20, electrical and/or optical connection may be made between one or more electrical and/or optical conductors, shown generally at 36 in the first well logging instrument housing, to an electrical and/or optical conductor (not shown separately) disposed inside a conductor conduit 28 in the flexible coupling 10.

Corresponding electrical and/or optical connection may be made between a feed through connector 32 in an internal passage 23 in the second housing segment 22 and an electrical and/or optical connector 38 disposed in the mating feature 14A in the second well logging instrument housing 14. The electrical and/or optical connector 38 may be connected to electrical and/or optical conductors, shown generally at 40, in the second well logging instrument housing 14. The connector 38 may or may not be sealed using o-rings 48 or similar sealing device.

The number of electrical and/or optical conductors and connections shown in FIG. 1 is only meant to illustrate the principle of a flexible coupling according to the invention and is not intended to limit the scope of the present invention. What will be apparent to those skilled in the art is that the portion of the passage 21 in the first housing segment 20 disposed on the side of the feedthrough connector 30 opposite to the first housing connector 34, and the passage 23 in the second housing segment 22 disposed on the side of the feedthrough connector 32 opposite the second housing connector 38 may be exposed to wellbore fluid while preventing entry of the fluid into either of the chambers 12A, 14A.

The conduit 28 is preferably sealingly engaged at its ends with a respective one the respective feedthrough connectors 30, 32. Thus, the interior of the conduit 28 is maintained at atmospheric pressure and is in communication with the interior chambers of each well logging instrument housing. It should be understood that other examples may omit the feedthrough connectors. It is only necessary for purposes of the invention for the conduit to sealing engage the respective openings in the housing segments.

The conduit should be assembled to each of the first 20 and second 22 housing segments such that the longitudinal ends of the conduit 28 are positionally fixed with respect to each of the first 20 and second 22 housing segments. The conduit 28 therefore may be made from a material having wall thickness selected to resist fluid pressure in the wellbore without crushing, and define an internal diameter sufficient to enable passage therethrough of one or more electrical and/or optical conductors (not shown). One example of such a material is stainless steel tubing. The conduit 28 preferably includes one or more bending stain distribution features such as coils 28A wound approximately coaxially with the pivot 24 to enable the first housing segment 20 to be axially angularly displaced with respect to the second housing segment 22 without breaking or kinking the conduit 28. The one or more coils 28A define a feature that distributes bending strain on the conduit 28 over a sufficient length such that under the maximum expected angular deflection of the first housing segment 20 with respect to the second housing segment 22 the elastic limit of the conduit 28 is not exceeded. In some examples the coil 28 defines a predetermined bending strain distribution length.

Figure 1A:
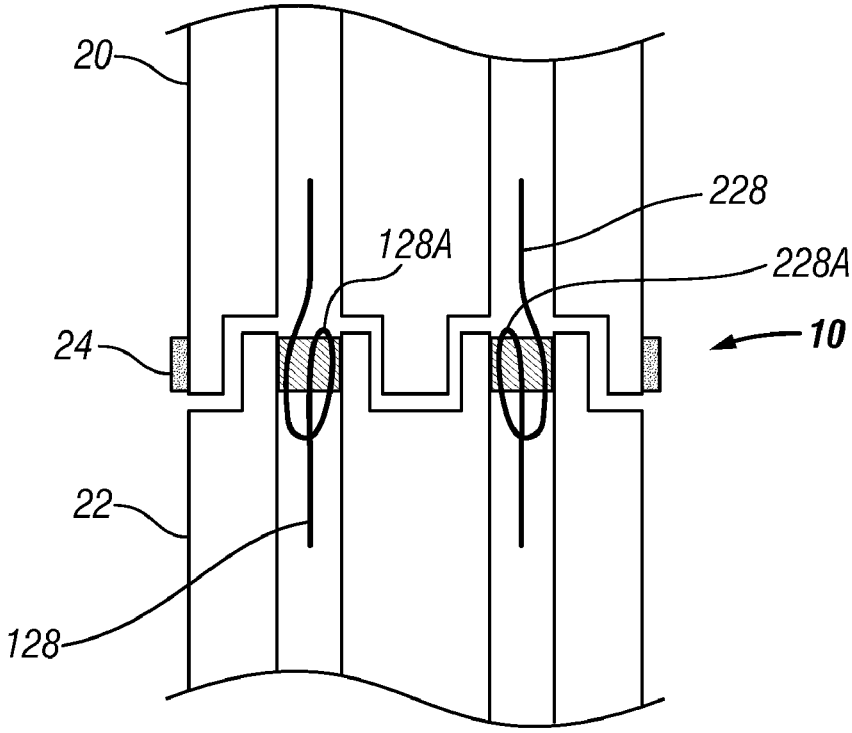
FIG. 1A shows another example coupling as in FIG. 1 with the addition of a second conductor conduit.

In one example, and referring to FIG. 1A, the flexible coupling 10 may include two conduits 128, 228 sealingly engaged with the first 20 and second 22 housing segments. The sealing engagement may be substantially as explained above with reference to FIG. 1. In the example of FIG. 1A, the two conduits 128, 228 each include a respective bending strain distribution feature such as a coil 128A, 228A. The coil of each conduit is mounted so that its winding is in a direction opposite to that of the other coil. By arranging two conduits with opposed wound coils as shown in FIG. 1A, additional cross sectional area may be provided for electrical and/or optical conductors, and any tendency of the coils to self-wind or self-unwind under external hydrostatic pressure will be counteracted by the opposed wind of the other coil. Thus, any torque generated by each coil resulting from the Bourdon-tube effect will be substantially neutralized by the countervailing torque exerted by the other coil.

Figure 2:
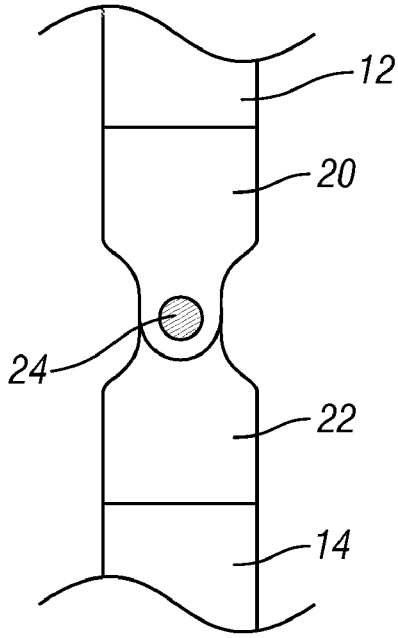
FIG. 2 shows a side view of the example flexible coupling shown in FIG. 1, wherein the view is rotated 90 degrees from the view shown in FIG. 1.

FIG. 2 shows a side view of the assembled first well logging instrument housing 12 coupled to the first housing segment 20, the first housing segment 20 coupled to the second housing segment 22 by the pivot 24 and the second housing segment 22 coupled to the second well logging instrument housing 14. The view shown in FIG. 2 is rotated by about 90 degrees from the view shown in FIG. 1. The first housing segment 20 and the second housing segment 22 may be shaped or include features (not shown) to limit the amount of angular displacement of the first housing segment 20 with respect to the second housing segment 22 so that the conduit (28 in FIG. 1) does not kink or break.

Returning to FIG. 1, to assemble the flexible coupling 10, the ends of the conduit 28 may be inserted into respective feedthrough connectors 30, 32. The feedthrough connectors 30, 32 may be inserted into their respective passages 21, 23. Cooperative features 24A, 24B on the first housing segment 20 and second housing segment 22, respectively, for engaging the pivot 24 may be aligned, and the pivot 24 inserted therethrough. Preferably the coil 28A is disposed such that the pivot 24 passes therethrough during assembly.

Other examples of a flexible coupling made according to the invention may include a plurality of conduits sealingly engaged at their ends with the first housing segment and the second housing segment. A plurality of such conduits may each be formed to include a respective coil or similar bending strain distribution feature. Using a plurality of such conduits of relatively small internal diameter instead of one larger diameter conduit can enable a greater wiring cross-sectional area without exceeding the conduit material yield strain, for any given required flex angle across the coupling.

In some examples, the conduit may be made from titanium tube material of its high strength and relatively lower modulus than materials such as stainless steel.

Preferably the conduit is bent in such a way, e.g. mandrel bending, to reduce deformation of the cross section of the conduit from substantially circular or a reduction in the diameter of the conduit. Maintaining full diameter and substantially circular cross section may decrease the chance of pressure collapse of the conduit.

In any case, the conduit may be formed without prior insertion of electrical and/or optical conductors therethrough.

A flexible coupling made according to the invention may provide a device to enable relative axial displacement of joined together well logging instruments without the need to provide a seal that enables relative motion between components. Such a coupling may be more reliable and less expensive to operate and maintain than flexible couplings known in the art prior to the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A flexible coupling for well logging instruments joined end to end, comprising:

a first well logging instrument housing coupled at one longitudinal end to one end of a second well logging instrument housing, each of the first and second well logging instrument housings defining a sealed, open interior chamber maintained substantially at atmospheric pressure, the first and second instrument housings coupled to enable angular deflection between respective longitudinal axes thereof; and a first conduit extending between the first well logging instrument housing and the second well logging instrument housing, the first conduit sealingly engaged to each well logging instrument housing, the first conduit maintained substantially at atmospheric pressure therein, the sealing engagement configured such that longitudinal ends of the first conduit are substantially positionally fixed with respect to each well logging instrument housing, the first conduit formed from material and having dimensions selected to withstand at least a same hydrostatic pressure as each of the first and second well logging instrument housings, the first conduit including a bending strain distribution feature configured such that at a maximum angular deflection between the first instrument housing and the second instrument housing a bending strain in the first conduit is at most equal to an elastic limit of the first conduit, the first instrument housing rotationally fixed with respect to the second instrument housing about respective longitudinal axes thereof.

2. The flexible coupling of claim 1 wherein the first conduit comprises steel tubing.

3. The flexible coupling of claim 2 wherein the bending strain distribution feature in the first conduit comprises a coil in the steel tubing.

4. The flexible coupling of claim 3 further comprising a second conduit extending between the first well logging instrument housing and the second well logging instrument housing, the second conduit sealingly engaged to each well logging instrument housing such that longitudinal ends of the second conduit are substantially positionally fixed with respect to each well logging instrument housing, the second conduit formed from material and having dimensions selected to withstand at least a same hydrostatic pressure as each of the first and second well logging instrument housings, the second conduit including a bending strain distribution feature configured such that at a maximum angular deflection between the first instrument housing and the second instrument housing a bending strain in the second conduit is at most equal to an elastic limit of the second conduit.

5. The flexible coupling of claim 4 wherein the second conduit comprises steel tubing.

6. The flexible coupling of claim 5 wherein the bending strain distribution feature in the second conduit comprises a coil in the steel tubing, a wind of the coil in the second conduit opposed to a wind of the coil in the first conduit to substantially neutralize pressure induced torque exerted by the first and the second conduits.

7. The flexible coupling of claim 1 wherein the first instrument housing and the second instrument housing are coupled by a pivot.

8. A flexible coupling for well logging instruments joined end to end, comprising:

a first well logging instrument housing coupled at one longitudinal end to one end of a second well logging instrument housing, each of the first and second well logging instrument housings defining a sealed interior chamber, the first and second instrument housings coupled to enable angular deflection between respective longitudinal axes thereof;

a first conduit extending between the first well logging instrument housing and the second well logging instrument housing, the conduit sealingly engaged to each well logging instrument housing such that longitudinal ends of the first conduit are substantially positionally fixed with respect to each well logging instrument housing, the first conduit formed from material and having dimensions selected to withstand at least a same hydrostatic pressure as each of the first and second well logging instrument housings, the first conduit including a bending strain distribution feature configured such that at a maximum angular deflection between the first instrument housing and the second instrument housing a bending strain in the first conduit is at most equal to an elastic limit of the first conduit;

a second conduit extending between the first well logging instrument housing and the second well logging instrument housing, the second conduit sealingly engaged to each well logging instrument housing such that longitudinal ends of the second conduit are substantially positionally fixed with respect to each well logging instrument housing, the second conduit formed from material and having dimensions selected to withstand at least a same hydrostatic pressure as each of the first and second well logging instrument housings, the second conduit including a bending strain distribution feature configured such that at a maximum angular deflection between the first instrument housing and the second instrument housing a bending strain in the second conduit is at most equal to an elastic limit of the second conduit;

wherein the first and second conduits comprise steel tubing, the bending strain distribution feature in the first and second conduits comprises a coil in the steel tubing, and a wind of the coil in the second conduit opposed to a wind of the coil in the first conduit to substantially neutralize pressure induced torque exerted by the first and the second conduits.

* * * * *